US006669523B1

(12) United States Patent
Olwert et al.

(10) Patent No.: US 6,669,523 B1
(45) Date of Patent: Dec. 30, 2003

(54) METHOD OF DIMENSIONALLY STABILIZING A TUNGSTEN FILAMENT

(75) Inventors: Ronald J. Olwert, Concord Township, OH (US); John T. Pastir, Eastlake, OH (US)

(73) Assignee: General Electric Company, Schenectady, NY (US)

( * ) Notice: Subject to any disclaimer, the term of this patent is extended or adjusted under 35 U.S.C. 154(b) by 596 days.

(21) Appl. No.: 09/644,597

(22) Filed: Aug. 23, 2000

(51) Int. Cl.[7] ..... H01K 3/02
(52) U.S. Cl. ..... 445/48
(58) Field of Search ..... 445/48, 32

(56) References Cited

U.S. PATENT DOCUMENTS

| | | | | |
|---|---|---|---|---|
| 3,208,811 A | * | 9/1965 | Mason | 445/6 |
| 3,285,293 A | * | 11/1966 | Matheson | 140/71.5 |
| 4,012,659 A | * | 3/1977 | Passmore et al. | 313/344 |
| 4,065,740 A | | 12/1977 | Earhart et al. | |
| 4,283,653 A | | 8/1981 | Brett | |
| 4,291,444 A | * | 9/1981 | McCarty et al. | 445/48 |
| 5,072,147 A | * | 12/1991 | Pugh et al. | 313/341 |
| 5,380,230 A | * | 1/1995 | Smith et al. | 445/32 |
| 5,773,724 A | | 6/1998 | Unterseh | |
| 6,161,598 A | | 12/2000 | Eder et al. | |

FOREIGN PATENT DOCUMENTS

| | | |
|---|---|---|
| EP | 456 054 | 11/1991 |
| EP | 849 770 | 6/1998 |
| GB | 610 864 | 10/1948 |
| JP | 60180460 | 9/1985 |
| JP | 61185905 | 8/1986 |

OTHER PUBLICATIONS

Patent Abstracts of Japan vol. 004, No. 009 (M–089), Jan. 23, 1980 & JP 54 144782 A (Toshiba Corp), Nov. 12, 1979. Database WPI Section Ch, Week 197624 Derwent Publications Ltd., London, GB; Class L03, AN 1976–44630X XP002184566 & JP 51 048585 A (Tokyo Shibaura Electric Co), Apr. 26, 1976.

* cited by examiner

*Primary Examiner*—Kenneth J. Ramsey
(74) *Attorney, Agent, or Firm*—Pearne & Gordon LLP

(57) ABSTRACT

A method of establishing coil dimensional stability by thermally stress relieving the tungsten filament prior to mounting in a lamp. The filament is manipulated into the desired position by coiling it first around a primary mandrel, then a retractable secondary mandrel. After the secondary mandrel is removed, the filament is held in place by a pair of electrical contacts. A current is passed through the primary coil, which heats the tungsten and causes it to recrystallize. The recrystallization provides the desired dimensional stability.

23 Claims, 1 Drawing Sheet

METHOD OF DIMENSIONALLY STABILIZING A TUNGSTEN FILAMENT

BACKGROUND OF THE INVENTION

Tungsten filaments used primarily in halogen and incandescent lamps are coiled coils, i.e. the tungsten filament or wire is coiled once around a primary mandrel to form the primary coil or the primary set of coils, then that set of coils itself is coiled (the "secondary set of coils"). In the development of a new lamp, it was found that the secondary set of coils of the tungsten filament would become very distorted after the lamp was operated for only a minute. The distortion was so severe that the vertical legs of this filament actually shorted out against the secondary set of coils. Shorting out only one secondary coil reduces the life of the product to approximately 20% of the design life for a filament with only six secondary coils. In order to achieve design life, the coil dimensions needed to be stabilized.

A known method for achieving coil dimensional stability in a tungsten filament with vertical legs is to screw the completed filament (with no primary mandrel in the coil) on a mandrel form, clamp the vertical legs in place, and heat the filament in a vacuum furnace for 2 to 10 hours. After this process, a tungsten plug is inserted into the primary set of coils' leg to aid in welding the filament to molybdenum foil. For high wattage coils with large wire diameters this is possible. In fine wire coils, high shrinkage (losses of coils) would be incurred due to handling. Furthermore, with both large and fine coils, this process is both labor and time intensive.

Thus, there is a need for a cost effective method of stabilizing the coil dimensions of a tungsten filament with vertical legs by thermally stress relieving the coil prior to mounting in a lamp. This process is useful to prevent the filament from distorting and shorting out the secondary set of coils when the lamp is operated.

SUMMARY OF THE INVENTION

A method of dimensionally stabilizing a tungsten filament prior to installation in a lamp comprising the steps of providing a tungsten filament which has been manipulated into a desired shape around a primary mandrel to provide a primary coil, inducing a current in the primary coil, and maintaining the current until the tungsten filament at least partially recrystallizes.

DETAILED DESCRIPTION OF THE PREFERRED EMBODIMENTS

Figure 1:
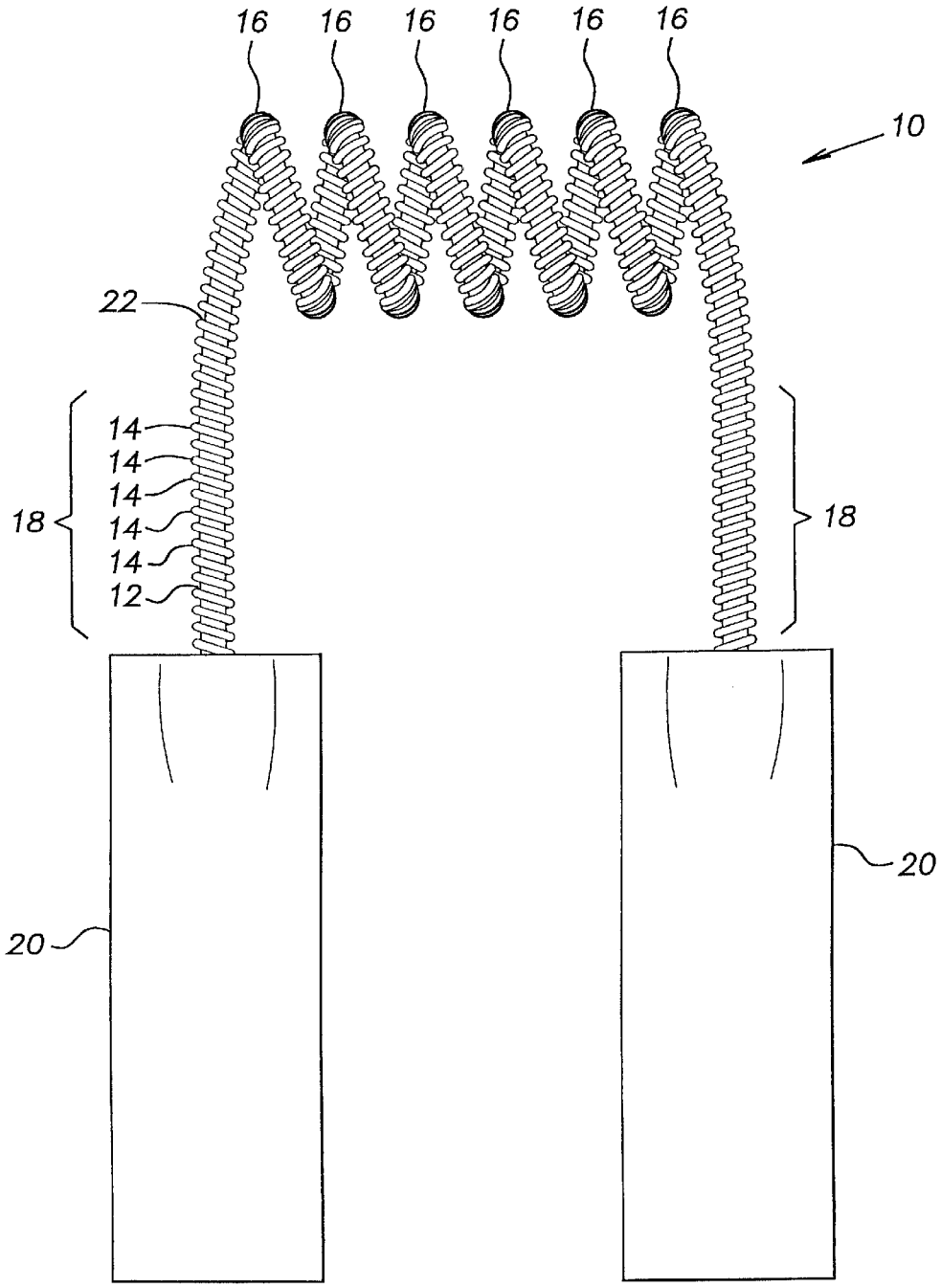
FIG. 1 is a perspective view of a tungsten filament used in accordance with the present invention.

FIG. 1 shows a typical tungsten filament 10 that is used primarily in halogen and incandescent lamps, but also in fluorescent lamps. The radii and lengths of these filaments are known in the art. A length of tungsten filament or wire 12 is first wrapped around a primary mandrel 22, for example, a length of molybdenum wire, to form a primary coil. This gives the tungsten its primary set of coils. While the tungsten is still wrapped around the primary mandrel 22, the tungsten and the primary mandrel 22, which form the primary coil, are wrapped around a retractable secondary mandrel. This process forms a secondary set of coils 16. The secondary mandrel is usually a steel chuck, although other retractable mandrels as are known in the art may be used. The chuck has an outside diameter that is equal to the desired inside diameter of the secondary coils 16. Sections at both ends of the length of tungsten are not wrapped around the secondary mandrel. These sections become the vertical legs 18 of the primary coil and of the tungsten filament 10. In some situations the invention can be practiced without the secondary set of coils 16, for example when the primary mandrel is more than 5 times the diameter of the tungsten wire, for example when the tungsten wire is a fine wire such as less than 1.2 mils diameter.

After the secondary coiling on the retractable mandrel, the filament is held at the ends of the vertical legs 18 by a pair of electrical contacts 20. The retractable mandrel is removed from the tungsten filament 10. However, the primary mandrel 22 (the molybdenum wire) is still intact and serves to maintain the dimensions of the tungsten filament 10 as wound. If the primary mandrel 22 is not present during this process, the filament 10 "squirms" or becomes dimensionally unstable, causing the secondary coils 16 to distort to the point of making contact with each other and short circuiting the coil.

The electrical contacts 20 holding the vertical legs 18, the tungsten filament 10 and the primary mandrel 22 are all placed into a reducing atmosphere that is known in the art. The reducing atmosphere comprises substantially $N_2$ with sufficient $H_2$ to effectively prevent oxidizing of the tungsten filament 10. Preferably, the reducing atmosphere comprises about 90% $N_2$ and about 10% $H_2$. A current is then passed through the primary coil via the electrical contacts 20. The current causes the tungsten filament to heat sufficiently to recrystallize or partially recrystallize while held in the desired coil shape. This recrystallization provides the necessary dimensional stability.

The amount of current necessary varies, depending on the degree of recrystallization desired and the size of the tungsten filament 10 and the primary coil. As the coil size increases, the current necessary to achieve a constant degree of recrystallization will also increase. Likewise, for a given coil size, as the desired degree of recrystallization increases, the current necessary will also increase. The amount or degree of recrystallization is preferably at least 30, 40, 50, 60, 70, 80, 90 or 95% and is optionally less than 95%. As is known in the art, for a certain size filament, the current and time necessary to achieve a preselected degree of recrystallization can be ascertained by running a series of trials. For example, to achieve about 80% recrystallization for tungsten filaments having a diameter of between 1.0 to 1.5 to 1.9 to 2.5 to 3.0 to 3.5 to 4.0 to 4.3 to 4.5 mils, the voltage used to induce the current can range from 1 to 2 to 3 to 4 to 5 to 6 to 7 to 8 to 9 to 10 to 15 to 20V, if the voltage is maintained from 1 to 2 to 3 to 4 to 5 to 10 to 20 to 30 to 40 seconds. However, the method of the present invention can be used with any size filament.

When the filament 10 achieves the desired degree of recrystallization, it is cooled. The first mandrel 22 is then removed by dipping the recrystallized filament and mandrel 22 in an acid bath that will dissolve the molybdenum, but not the tungsten. However, it is desired to keep the primary mandrel 22 in the vertical legs 18, as the presence of the molybdenum is helpful when the filament is resistance welded to the molybdenum foils inside the lamp. Thus, the vertical legs 18 are covered when the filament 10 is dipped in the acid bath, to prevent dissolving the molybdenum in the vertical legs 18. Any material which will not dissolve in the acid bath which is known in the art, for example, wax, may be used to cover the vertical legs 18.

It is also advantageous, while welding the vertical legs 18 to the molybdenum foils, if the vertical legs 18 are still fibrous, i.e., they have not recrystallized. This result is achieved in the present invention by the presence of the electrical contacts 20. The contacts 20 hold the vertical legs 18 while the electrical current passes through the body of the filament 10. The contacts 20 can be made from, for example, tungsten, although any appropriate conducting metal may be used. The contacts 20 preferably have a diameter of about ⅛" and are about 1½" long, although any size may be used, as long as the contacts are large enough to hold the filament. The current heats the tungsten filament to the point of recrystallization. As the filament 10 heats up, the contacts 20 act as heat sinks, absorbing the heat from the vertical legs 18. The vertical legs 18 never heat to a point where they will recrystallize because the heat is transferred from the vertical legs 18 to the electrical contacts 20. Thus, the vertical legs 18 remain fibrous and less brittle, which aids in welding the vertical legs 18 to the molybdenum foils.

The following Example further illustrates various aspects of the invention.

EXAMPLE

A tungsten filament having a diameter of 4.3 mils, to be used in a 5 W 24V lamp, is coiled around a primary mandrel of molybdenum. The tungsten and molybdenum are coiled around a retractable secondary mandrel, which is then removed. The legs of the filament are held in electrical contacts while the filament and contacts are in a reducing atmosphere (90% $N_2$, 10% $H_2$). A voltage is applied across the filament and primary coil to induce a current in order to thermally stress relieve the filament. The current is varied to achieve various degrees of recrystallization of the tungsten wire in the coil body, while the legs of the filament remain fibrous. The voltage was maintained for a constant time of 2.8 seconds with current varying to achieve the degrees of recrystallization as noted below:

| | Coil Body Length (mm) | | |
|---|---|---|---|
| % Recrystallized | After 2nd Coiling (A) | In Finished Lamp (L) | Coil Contraction (L − A) |
| 45 | 3.63 | 3.24 | −.39 |
| 60 | 3.53 | 3.24 | −.29 |
| 65 | 3.67 | 3.45 | −.22 |
| 80 | 3.53 | 3.44 | −.09 |

In order to achieve 80% recrystallization, the voltage was set at 5V. After the recrystallization process, the coil body length was measured. The coils were finished and mounted into lamps. The lamps were operated 1 minute and the coil body was measured again. From the data above, as the degree of recrystallization increases, the amount of coil contraction decreases. Therefore, the dimensional stability of the coil increases.

Although the preferred embodiments of the invention have been shown and described, it should be understood that various modifications may be resorted to without departing from the scope of the invention as disclosed and claimed herein.

What is claimed is:

1. A method of dimensionally stabilizing a tungsten filament prior to installation in a lamp comprising the steps of:

providing a tungsten filament which has been wound around a primary mandrel to provide a primary coil in contact with said primary mandrel, contacting said filament-wound primary mandrel with a first electrical contact adjacent a first end of said filament and with a second electrical contact adjacent a second end of said filament, inducing a current in the primary mandrel between said first and second electrical contacts, said current being effective to heat the tungsten filament wound around and in contact with said primary mandrel to a temperature sufficient to recrystallize tungsten therein, and maintaining the current until the tungsten filament at least partially recrystallizes.

2. A method according to claim 1, further comprising the step of manipulating the tungsten filament into the desired shape.

3. A method according to claim 2, wherein the manipulating step comprises winding the tungsten filament around the primary mandrel.

4. A method according to claim 3, wherein the primary mandrel is a length of molybdenum wire.

5. A method according to claim 3, wherein the manipulating step further comprises winding the tungsten filament and the primary mandrel around a secondary mandrel.

6. A method according to claim 5, further comprising, prior to the inducing step, the step of removing the secondary mandrel.

7. A method according to claim 1, further comprising the step of holding the tungsten filament in the desired shape.

8. A method according to claim 7, wherein the holding step comprises holding the tungsten filament at its ends with said first and second electrical contacts.

9. A method according to claim 8, wherein the contacts have a diameter of about ⅛ inch and are about 1½ inches long.

10. A method according to claim 1, wherein the maintaining step is performed until the tungsten filament is at least 30% recrystallized.

11. A method according to claim 1, wherein the maintaining step is performed until the tungsten filament is about 80% recrystallized.

12. A method according to claim 1, wherein the inducing step is performed in a reducing atmosphere.

13. A method according to claim 12, wherein the reducing atmosphere comprises about 90% $N_2$ and about 10% $H_2$.

14. A method according to claim 1, further comprising the step of removing a portion of the primary mandrel.

15. A method according to claim 14, wherein the step of removing said portion of the primary mandrel comprises contacting a portion of the tungsten filament and primary mandrel with a solution that is effective to dissolve the primary mandrel, but is not effective to dissolve the tungsten.

16. A method according to claim 15, wherein part of the tungsten filament and primary mandrel are covered with a substance effective to protect the primary mandrel from the solution.

17. A method according to claim 1, wherein the current is maintained between 1 and 40 seconds.

18. A method according to claim 1, wherein the tungsten filament has a diameter between 1.0 and 4.5 mils.

19. A method according to claim 1, wherein the current is induced by applying a voltage between the first and second electrical contacts.

20. A method according to claim 19, wherein the voltage has a value between 1 and 20 volts.

21. A method according to claim 1, further comprising the step of:

prior to said contacting step, providing said filament-wound primary mandrel with a first substantially horizontal portion, and second and third substantially vertical leg portions, said first substantially horizontal portion being located between said second and third substantially vertical leg portions, said first and second ends of said filament being located at terminal ends of said first and second substantially vertical leg portions respectively.

22. A method according to claim 1, said first substantially horizontal portion having a secondary coiling, said secondary coiling having been provided by winding said filament-wound primary mandrel around a secondary mandrel having a diameter larger than said primary mandrel, said secondary mandrel being retracted prior to said inducing step.

23. A method according to claim 1, further comprising the step of installing said at least partially recrystallized tungsten filament in a lamp.

* * * * *